United States Patent [19]

Rosen

[11] Patent Number: 4,648,161

[45] Date of Patent: Mar. 10, 1987

[54] JEWELRY CLASP

[76] Inventor: Max Rosen, 245 Sunnyside Rd., Oceanside, N.Y. 11572

[21] Appl. No.: 798,868

[22] Filed: Nov. 18, 1985

[51] Int. Cl.[4] ..... A41F 1/04

[52] U.S. Cl. ..... 24/589; 24/71 J; 24/644; 24/702

[58] Field of Search ..... 24/71 J, 589, 68 J, 24/69 J, 302, 353, 354, 588, 630, 631, 632, 636, 644, 658, 665, 681, 702, 265 R, 265 B, 265 BC, 265 EC, 265 WS

[56] References Cited

U.S. PATENT DOCUMENTS

| | | | |
|---|---|---|---|
| 1,749,997 | 3/1930 | Carlson | 24/71 J |
| 3,889,323 | 6/1975 | Reith | 24/265 B |
| 4,541,151 | 9/1985 | Herchenbach et al. | 24/71 J X |

FOREIGN PATENT DOCUMENTS

| | | | |
|---|---|---|---|
| 943056 | 2/1949 | France | 24/589 |
| 1066710 | 6/1954 | France | 24/589 |
| 1325860 | 3/1963 | France | 24/589 |
| 1423840 | 11/1965 | France | 24/589 |
| 353927 | 6/1961 | Switzerland | 24/589 |
| 863556 | 3/1961 | United Kingdom | 24/589 |
| 930399 | 7/1963 | United Kingdom | 24/644 |
| 1016636 | 1/1966 | United Kingdom | 24/589 |
| 1138122 | 12/1968 | United Kingdom | 24/589 |

*Primary Examiner*—Kenneth J. Dorner
*Assistant Examiner*—Laurie K. Cranmer
*Attorney, Agent, or Firm*—Bauer & Amer

[57] ABSTRACT

A two-part clasp has female and male members with the female member being provided with a bore and a slot and into which a prong on the male member interfits for lateral engagement. The female member is provided with a latch which moves beneath the members to engage the male member and prevent it from lateral disengagement with the female member.

15 Claims, 15 Drawing Figures

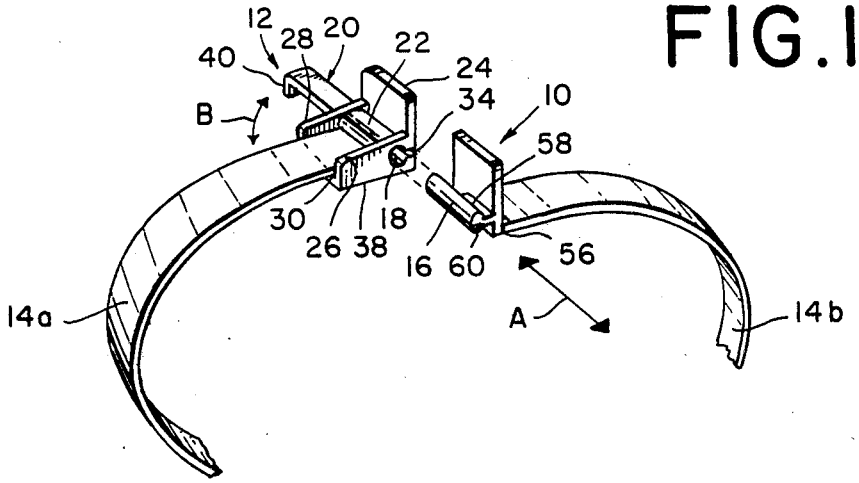
FIG.1
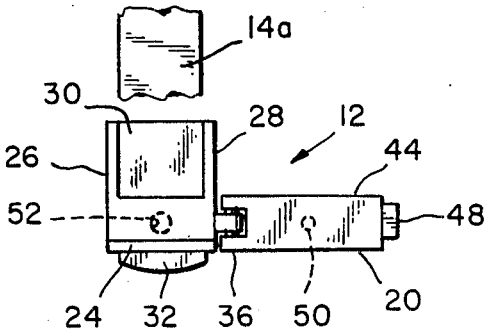
FIG.5
FIG.4
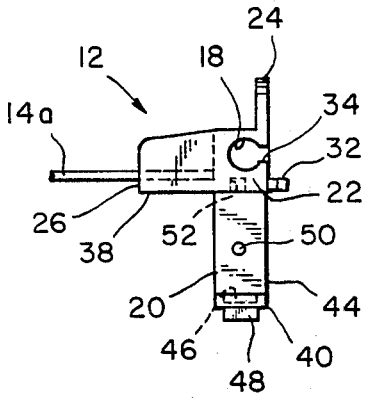
FIG.3
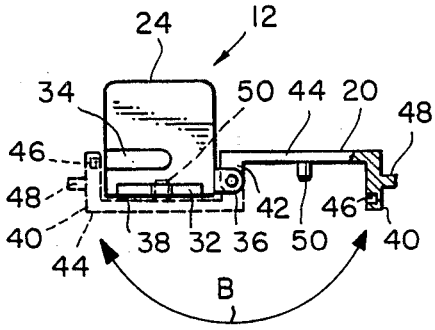
FIG.2
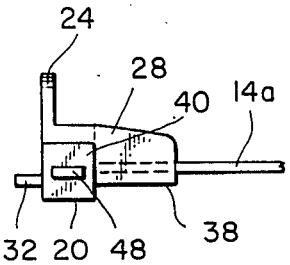
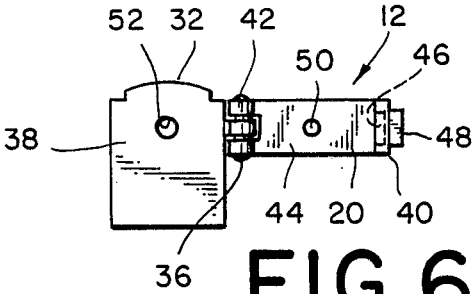
FIG.6

FIG.8
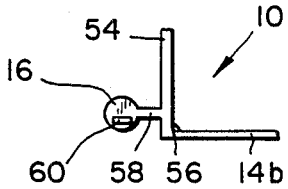
FIG.7
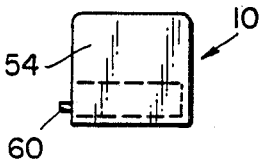
FIG.9
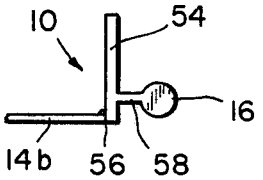
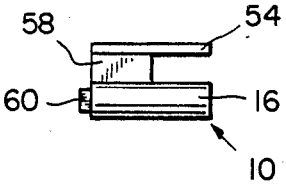
FIG.10
FIG.11
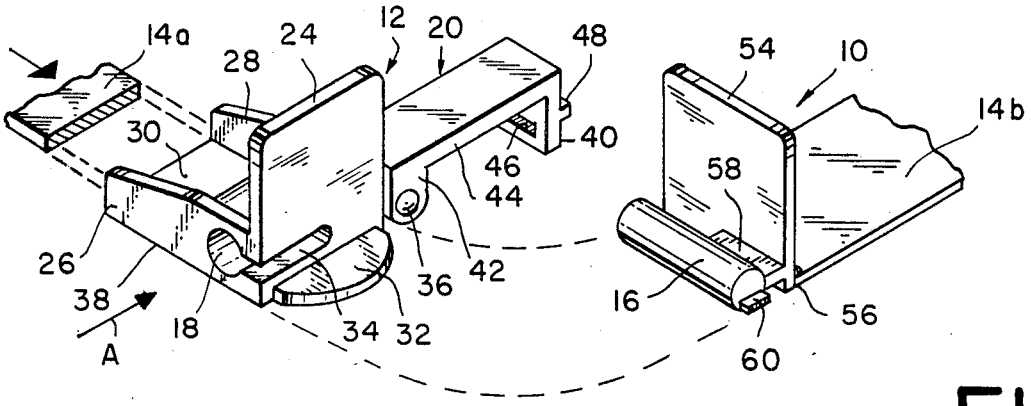
FIG.12
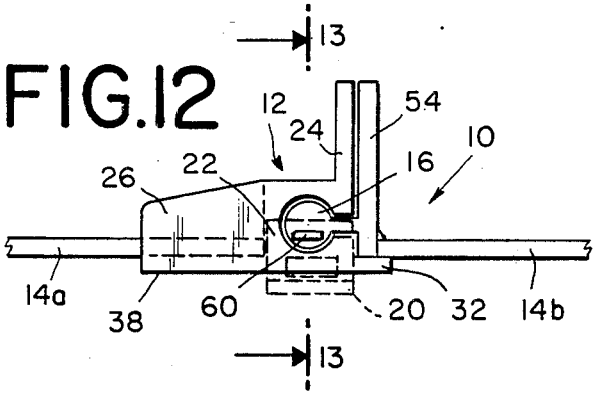
FIG.13
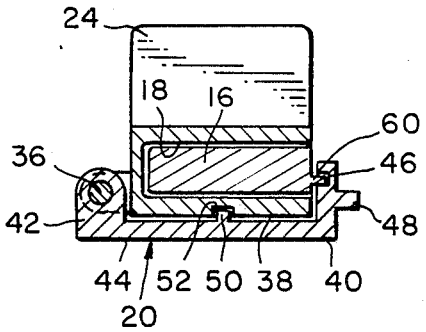
FIG.14
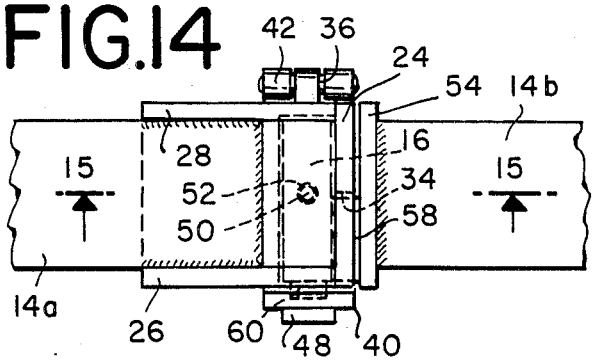
FIG.15
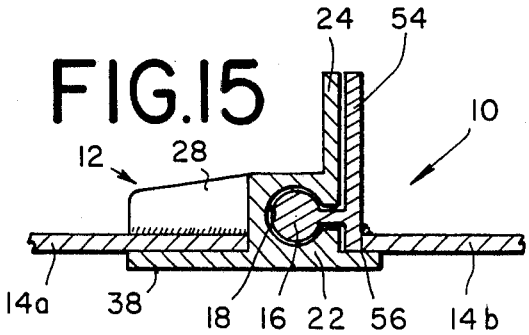

JEWELRY CLASP

BACKGROUND OF THE INVENTION

The present invention relates to a clasp for jewelry, particularly for bracelets, wrist bands, necklaces and the like.

The function of a jewelry clasp or closure is not only to make initial contact between the ends of the bracelet, or the like, but to ensure during use of the jewelry piece that these ends do not inadvertently separate and thereby give rise to a situation wherein the jewelry piece may fall from the wearer and become lost.

It is therefore an object of the present invention to provide a clasp, in which a double locking occurs, ensuring to the greatest extent possible, against the accidental dislodgement of the jewelry piece during use.

It is a particular object of the present invention to provide a clasp in which the jewelry piece members are engaged in a sliding lateral engagement, instead of just an end-to-end engagement so as to prevent disengagement by longitudinal pulling, and in addition to provide a snap fastening latch which secures the engaging members in place against lateral separation.

These objects together with other objects and advantages will be apparent in the foregoing disclosure.

SUMMARY OF THE INVENTION

According to the present invention, a two-part clasp is provided comprising a female and a male member. The female member has a base, a frontal upstanding wall and a pair of side walls stradling the base and extending rearwardly from the frontal wall. A bore is formed inwardly from one side wall partially through the base and a slot is cut through the frontal wall in communication with the bore. The male member has an upstanding wall from which a projection extends laterally across the front surface and a prong is supported integrally with the projection so as to be spaced from said upstanding wall.

The projection and the prong are coextensive with the slot and bore respectively and are insertable into the slot and bore to laterally interengage the male and female members while the frontal walls of said members slide in abutment. A substantially U-shaped latch element is hingedly secured by an arm to the other side wall of the female member to pivot about an axis perpendicular to the abutting frontal walls. The latch element is movable beneath said female member so that its opposite arm extends over the one side wall of the female member in engagement with the end of the prong as received in the bore, thus acting to prevent lateral disengaging movement of the male member.

The female member may be provided with a ledge extending from the frontal wall on which the male member is supported during its sliding movement. The ledge thus makes it simpler for the wearer to open and close the clasp, using one hand.

Full details of the invention are set forth in the following description and are illustrated in the accompanying drawings.

BRIEF DESCRIPTION OF THE DRAWINGS

In the drawings:

FIG. 1 is an isometric view showing male and female parts of the present invention as applied to a bracelet;

FIG. 2 is a front elevational view of the female member of the clasp embodying the present invention;

FIG. 3 is a side elevational view of the female member shown in FIG. 2 with the latch pivotted downward;

FIG. 4 is the opposite side elevational view of the female member of FIG. 2;

FIG. 5 is a top plan view of the female member;

FIG. 6 is a bottom plan view of the female member in FIG. 2;

FIG. 7 is the front elevational view of the male member embodying the present invention;

FIG. 8 is a side view of the male member;

FIG. 9 is the opposite side view of the male member;

FIG. 10 is top plan view of the male member;

FIG. 11 is an isometric view showing the assembly of the clasp embodying the present invention;

FIG. 12 is a side elevational view of the assembled clasp;

FIG. 13 is a sectional view of FIG. 12 taken along lines 13—13;

FIG. 14 is a top view taken of the FIG. 12 and

FIG. 15 is a sectional view taken along line 15—15 of the FIG. 14.

DESCRIPTION OF THE INVENTION

In the following description and in the drawings, the present invention is illustrated as a clasp for a bracelet. It will, of course, be understood that the present invention may be used as a clasp or fastening means for neckwear, earrings, watches bands and wrist bands and other jewelry items as well as for similarly formed but not necessarily jewelry devices. The materials are preferably made of precious or semi-precious metals but may be made of non precious metals and be plated to give a desired finish. The material of the clasp may also be made of suitable plastics.

Turning now to FIG. 1, the clasp comprises a male member generally depicted by the numeral 10 and a female member generally depicted by the numeral 12 both of which are respecively attached to the free ends of the jewelry item, here shown in two sections as a bracelet 14*a* and 14*b*. The male and female members 10 and 12 are linkable together by means of a lateral or sideways sliding movement in the direction shown by Arrow A by which a dowel shaped prong 16 is inserted within a blind hole or bore 18 and held against disengagement by a latch cover 20 which is pivotable below the female member so as to snap and fit over the free end of the prong 16. As the description proceeds, it should become apparent to those skilled in the art that the prong need not be round as is shown in the drawing for convenience of illustration.

As seen in detail in FIGS. 2–5, the female member comprises a base 22 having a smooth upstanding slide engaging facing wall 24 from which, extending rearward in a direction away therefrom is a pair of spaced side walls 26 and 28, between which is a horizontal ledge 30. A smaller and shorter ledge 32 extends forwardly of the facing wall 24 along the lower edge of the base 22. The rearwardly extending ledge 30 forms a support on which the end of the bracelet section 14*a* is placed and mounted and secured in place by soldering, riveting or any other convenient method.

The blind bore 18 extends through the base 22 which may be in the form of a solid rectangular block. The blind bore 18 is located or set back from the frontal facing wall 24 and communicates with the surface of the wall through an access key-slot 34. The blind bore 18 passes through one side wall 26 and through the base 22, almost to the opposite side 28, but terminates just short of reaching the opposite side 28. The key slot 34, on the other hand, is somewhat shorter than the blind bore 18 thereby leaving a substantial portion of the bore wholey closed and a length of it inaccessible through the wall 24.

The engagement latch cover 20 is pivotally connected to the blind side 28 of the base 22 by a hinge 36 so that the latch 20 can swing in the direction of the arrows B (FIG. 2) from a position extending laterally aligned with the base from the blind side 28 to a position flat and squarely beneath the base 22 and in abutment with the bottom surface 38 of the base. The latch cover 20 is formed as a small length of a generally U-shaped channel having a pair of side arms 40 and 42 separated by a central web 44. The arm 42 forms the leaf of the hinge 36 and its end is formed with appropriate loops for engagement about the pintle of the hinge.

The opposite arm 40 is free, and is formed with an elongated recess or engaging notch 46 on its inner surface and a small finger manipulating projection 48 on its outer surface which may be grasped by the finger or nail of the user to effect both engagement and disengagement of the latch cover. The central web 44 of the latch 20 is provided with a small pin 50, extending perpendicularly to the plane and midway of the length of the web 44. The pin 50 is adapted to fit into a hole 52 provided in and open from the bottom surface 38 of the female member 12.

The male member 10 is seen in better detail in FIGS. 8–10 and comprises an upstanding smooth planar facing wall 54 which is attached, preferably by soldering or welding its rear surface to the free end of second member 14b of the bracelet. It may be attached on the other hand in other conventional ways. The facing wall 54 is slightly shorter than the facing wall 24 of the female member 12 and the attachment to the bracelet 14b is made at its lowermost edge 56 as seen in FIGS. 1 and 11 so that a smooth continuum of the bracelet is provided.

The height of the male wall 54 is less than the wall 24 of the female member by the amount of the height of the ledge 32 above the bottom surface of the female member, so that the top edges of the male and female members are coextensive. This enables the male member 10 to be placed with the bottom edge 56 upon the short forward extending ledge 32 of the female member 12 so that the prong 16 is in lateral engaging registry with the bore 18. The dowel shaped prong 16 is secured to the facing wall 54 of the male member 10 by an integrally formed flat extension member 58 which is sized to freely enter the key slot 34 in the female member 12.

The length of the flat extension 58 conforms to the length of the key slot 34 while the prong 16 has a shape and length equal to that of the blind bore 18. Thus, the prong 16 is fully insertable in a lateral direction into the blind bore 18 and cannot interfere with or be interfered by the opening formed by the key slot 34. The outermost exposed end of the prong 16 is provided with a small extending latch engaging tip 60 adapted to cooperately fit and be engaged in the recessed latch notch 46 in the free arm 42 of the latch cover 20.

The clasp as described may be used swiftly and easily as illustrated in FIGS. 11–15. With the bracelet in the condition as shown in FIG. 11, the male member 10 is laterally aligned with the female member 12 as seen in FIG. 1 so that the engagement prong 16 registers with and is insertable axially within the blind bore 18 in the direction of arrow A of FIG. 1. As the prong 16 enters the bore 18 the frontal facing walls 24 and 54 of the male and female members 10 and 12 respectively, slide in abutment with and over each other. The bottom edge 56 of the male member 10 is guided to ride on the forward protruding ledge 32 of the female member 12.

This small protruding ledge 32 enables the male member 10 to be readily aligned more easily with the female member 12 than if reliance were made only upon the positioning of the prong 16 and bores 18. This is of particular advantage when the clasp is on a bracelet, or necklace since in both instances the clasp must be closed with basically one hand and without being able to be seen by the user. The prong 16 slides and is pressed fully into the blind bore 18. The plate extension 58 also slides within the key way 34 to assure that both members 10 and 12 are fully engaged.

Once the prong 16 is fully inserted in the bore 18, the facing walls 24 and 54 respectively, are in full faced abutment and alignment with each other and substantially congruent. It is now impossible to separate them in the direction of the length of the bracelet. The sliding abutment of the frontal faces 24 and 54 respectively insure that the two parts of the clasp are firmly and tightly joined to each other. Thereafter, it is merely necessary that the latch cover 20 be swung downwardly in direction of arrow B as in FIG. 2 beneath the bottom surface of the female member so that it lies flush and in facing engaging abutment with the bottom surface 38.

In this position, the pin 50 on the latch 20 enters into the hole 52 and the free arm 40 extends up over the end of the prong 16 so that its recess 46 snaps over the tip 60 to engage and hold the same in the notch. The engagement of the free arm 40 with the tip 60 prevents the disengagement of the latch cover 20 from its latching position and ensures that the male member 10 is not only fully seated in the female member but also can not be inadvertently disengaged therefrom. The pin 50, engaging with the pin hole 52, ensures that the latch cover 22 is further prevented from disengagement from the tip 60 on the exposed end of the prong 16 because when in use, the underside of the latch 20, presses downwardly against the surface of the skin of the wearer thereby biasing the pin 50 back into the pin hole 52 should the recessed notch 46 disengage from the latch tip 60. Thus, the pin and pin hole 50 and 52 establish a double lock engagement which will prevent separation of the latch cover 20 from its locked engagement with the tip 60 at the exposed edge of the prong 16.

The intended or desired disengagement of the clasp is easily made by grasping the projection 48 on the outer surface of the free arm 40 of the latch cover 20 and pressing downwardly in the contrary direction from that of engagement (contra-arrow B). This opens the latch cover 20 removing pin 50 from the pin hole 52 and exposing the prong 16. The male member 10 may then be slid laterally from engagement with the female member 12.

Various modifications, changes and embodiments have been described herein. Other modifications and embodiments will be clearly apparent to those skilled in the art. Accordingly, it is intended that the present disclosure be taken as illustrative only and not limiting of the present invention.

What is claimed is:

1. A clasp for joining the longitudinal ends of jewelry and the like for positioning adjacent the skin of a wearer comprising a male and a female member each having a planar frontal wall for mutual abutment and having top and bottom surfaces and sides, said male member having a prong with front and rear ends and said female member having a bore open at one end, said prong and bore extending from a respective one of said sides and laterally across the respective frontal walls, said prong being insertable by its front end into the open end of said bore to restrain said male and female members from separation during relative longitudinal movement, said female member having a latch attached to a side thereof opposite the open end of said bore in alignment with said bore, said latch and rear end of said prong having cooperating means for latching engagement with each other, said latch being pivotable about an axis perpendicular to a plane containing the frontal wall of said female member and swingable in a plane containing a central axis of said bore and beneath the bottom surface of said female member and between said female member and the adjacent skin of the wearer to engage its cooperating means with said prong cooperating means when said prong is disposed in the open end of said bore, said latch being held in engagement with said prong by the adjacent skin of the wearer and said cooperating means.

2. The clasp according to claim 1, wherein said prong cooperating means is formed with a tip extending axially from the rear end thereof, and said latch cooperating means is formed with an arm having a recess adapted to receive said tip when in engagement with the rear end of said prong, said latch being thereby snap-fastenable to said prong.

3. The clasp according to claim 2, wherein said latch is provided with an integrally formed pin extending therefrom in opposition to the bottom surface of the female member, and said female member is provided with a hole in its bottom surface to receive said pin, and prevent said latch from shifting relative to the bottom surface.

4. The clasp according to claim 1, wherein said female member includes a base integrally formed on the frontal wall thereof, and said frontal wall having a slot extending in communication with said bore, said male member having a planar projection extending from the frontal wall thereof and said prong being integrally formed along said planar projection, said bore and communicating slot and said prong and integral planar projection conforming in shape and size to each other for cooperative interengagement.

5. The clasp according to claim 4, wherein said communicating slot and said planar projection have a length less than the respective bore and prong.

6. A clasp for joining the longitudinal ends of jewelry and the like comprising a male and a female member each having a top, a bottom, side walls and having a planar frontal wall for mutual abutment, said male member having a prong and said female member having a bore open at one end, said prong and bore extending laterally across the respective frontal walls from one side wall, said prong being insertable at one end into the open end of said bore to restrain said members from separation during relative longitudinal movement, and a latch pivotable on the other side wall of said female member about the bottom thereof and swingable in a plane containing said bore into engagement with said prong in said one side wall when the same is in said bore to restrain said prong from removal from said bore.

7. The clasp according to claim 6 wherein the frontal walls of said male and female member each has a top and a bottom that are substantially coextensive when said members are interengaged.

8. The clasp according to claim 7 wherein said female member has a bottom surface and said latch is attached opposite the open end of said bore, said latch being pivotable about an axis perpendicular to a plane containing the frontal wall of said female member and swingable relative to said female member into abutment with the bottom surface thereof to engage said prong when the same is disposed in the open end of said bore to restrain said prong from removal from said bore.

9. The clasp according to claim 8, wherein said latch is provided with an integrally formed pin extending therefrom in opposition to a bottom surface of the female member and said bottom surface of said female member is provided with a hole to receive said pin to retain said latch in engagement with said prong.

10. The clasp according to claim 7. wherein said prong is formed with a tip extending axially from the other end thereof, and said latch is formed with an arm having a recess adapted to receive said tip when in engagement with the other end of said prong, said latch being thereby snap-fastenable to said prong.

11. the clasp according to claim 7, wherein said female member includes a base integrally formed on the frontal wall thereof, said bore being formed in said base, and said frontal wall having a slot extending in communication with said bore, said male member having a planar projection extending from the frontal wall thereof and said prong being integrally formed along said planar projection, said bore and communicating slot and said prong and integral planar projection being in registry for cooperative interengagement.

12. The clasp according to claim 11, wherein said communicating slot and said planar projection have a length less than the respective bore and prong.

13. A two-part clasp for positioning adjacent the skin of a wearer comprising a female member having a base, a frontal upstanding wall and a pair of side walls straddling said base and extending rearwardly from said frontal wall, a bore extending inwardly from one side wall partially through said base and a slot extending through said frontal wall in communication with the bore in said base, a male member having an upstanding wall having a projection extending laterally across the surface thereof and a prong integral with said projection spaced from said upstanding wall of said male member, said projection and said prong having one end insertable into said slot and bore from said one side wall to laterally interengage said male and female members to retain the frontal walls of said members in abutment, a substantially U-shaped latch element having one arm hingedly secured to the other side wall of said female member to pivot in a plane containing a central axis of said bore about an axis perpendicular to the abutting frontal walls to a latching position between said clasp and the adjacent skin of the wearer to provide the wearer an indication when said latch element is in its latching position and beneath said female member so that the other arm of said latch element extends over the other side wall of said female member in engagement with the other end of the prong in said bore to prevent separating movement of said male and female members, said latch element being held in its latching position by the adjacent skin of the wearer which feels the displacement of said latch when it disengages from said prong and moves out of its latching position.

14. The clasp as in claim 13, said prong and the other arm of said latch element having cooperable releasable engagement means.

15. The clasp as in claim 13, cooperable means on said latch element and said female member engageable with each other when said latch element is beneath said female element and engaged with said prong and releasable from engagement when said latch element is disengaged from said prong and moved out of its latching position.

* * * * *